US007363864B2

(12) United States Patent
Broek

(10) Patent No.: US 7,363,864 B2
(45) Date of Patent: Apr. 29, 2008

(54) MECHANIC'S TRACK CREEPER

(76) Inventor: Jonathan R. Broek, 482 Fourth Range Rd., Pembroke, NH (US) 03275

( * ) Notice: Subject to any disclaimer, the term of this patent is extended or adjusted under 35 U.S.C. 154(b) by 474 days.

(21) Appl. No.: 10/657,471

(22) Filed: Sep. 8, 2003

(65) Prior Publication Data

US 2005/0051048 A1 Mar. 10, 2005

(51) Int. Cl.
*E01B 25/22* (2006.01)

(52) U.S. Cl. ..... 104/106

(58) Field of Classification Search ..... 104/106, 104/107, 110; 280/32.6
See application file for complete search history.

(56) References Cited

U.S. PATENT DOCUMENTS

| | | | | |
|---|---|---|---|---|
| 4,185,846 | A * | 1/1980 | Black | 280/32.6 |
| 4,792,147 | A | 12/1988 | Wissing | 280/32.6 |
| 4,895,380 | A * | 1/1990 | Brooks et al. | 280/32.6 |
| 5,397,139 | A | 3/1995 | Simpson | 280/32.6 |
| 5,503,415 | A | 4/1996 | Powell | 280/32.6 |
| 5,711,227 | A * | 1/1998 | Johnson | 104/126 |
| RE35,732 | E | 2/1998 | Shockley | 280/32.6 |
| 5,730,449 | A | 3/1998 | Miles | 280/32.6 |
| 5,735,214 | A * | 4/1998 | Tsuboi | 105/29.1 |
| 6,076,838 | A * | 6/2000 | Peterson et al. | 280/32.6 |
| 6,476,603 | B2 * | 11/2002 | Clark et al. | 324/217 |

* cited by examiner

*Primary Examiner*—S. Joseph Morano
*Assistant Examiner*—Robert J. McCarry, Jr.
(74) *Attorney, Agent, or Firm*—Westman, Champlin & Kelly, P.A.

(57) ABSTRACT

A mechanic's track creeper is described, which includes a body, and a rail interface coupled to the body, wherein the rail interface of the creeper is operatively engageable with a rail having a translational axis, wherein the rail interface of the creeper comprises a means for ensuring proper alignment of the rail interface relative to the rail, and wherein the creeper is enabled to translate from a first position to a second position along the translational axis of the rail. A track including such a rail is also described, with an elongated dimension defining a translational axis, wherein the rail interface of the creeper is operatively engageable with the rail, and wherein the creeper is enabled to translate from a first position to a second position along the translational axis of the track.

15 Claims, 8 Drawing Sheets

MECHANIC'S TRACK CREEPER

FIELD OF THE INVENTION

The present invention relates to mechanic's creepers, and more particularly, mechanic's creepers with enhanced capabilities.

BACKGROUND OF THE INVENTION

Mechanic's creepers, sometimes known to those in the art simply as creepers, have traditionally been used to facilitate performing maintenance, repair or other mechanical work in restricted work environments, such as underneath and around vehicles, structures, and other mechanical or structural objects. They provide an alternative to sliding or wriggling one's body, typically while in a reclining or supine position, along the floor or ground in a restricted space.

Creepers generally comprise a platform suited for the mechanic to situate himself or herself in a reclining or supine position on the upper surface of the creeper, while the creeper is supported by a set of wheels or casters on the lower surface, providing an ability for the mechanic and creeper to translocate from one position to another. Some typical designs use swivel-mounted wheels or casters, in order to allow the creeper to translocate easily along both back-and-forth and side-to-side directions, providing for substantial freedom of motion along a substantially horizontal plane.

One typical application for usage of a creeper is to roll under a motor vehicle, for example, in order to access the vehicle's underside. This is typically done on a driveway or in a garage, where the ground or floor is substantially smooth, allowing the creeper's wheels or casters to roll along the floor substantially unhindered.

However, many applications where the usage of a creeper is highly desired, also pose considerable difficulty to the operation of the creeper. For instance, this is the case in environments where the ground surface within which a mechanic must work is rough, rocky, gravelly, sandy, soft, or otherwise not substantially smooth and hard. Many applications for usage of a creeper necessarily incorporate conditions such as these and cannot be delayed or transferred to a garage.

This is the case, for instance, when repair or maintenance must be done on specialized motor vehicles, trucks, construction equipment, and other mechanical machines located on a construction site or other field location. In such applications, it is typically a paramount priority to complete the maintenance or repair task quickly to allow the object requiring maintenance or repair to return to functional usage, while the cost of transporting the object off-site for maintenance or repair would be prohibitive. In other cases, the creeper must be used to access the underside of a fixture, such as a deck, an affixed trailer, a rig, or a pipeline. In these applications, there is no feasible option to transfer the object being accessed to a more convenient work environment.

While usage of creepers on such rough surfaces is thus a great priority, it is also very difficult. There is particular difficulty in the operation of the creeper's wheels or casters in traversing the surface, often adding a great deal of difficulty or stress to the mechanic's task or causing the wheels or casters, or their mountings, to sink in, erode or break.

New designs for creepers have therefore been introduced to try to improve their capacity to facilitate such jobs. For instance, larger wheels and mountings with reinforced strength have been introduced. However, these solutions do not ultimately alter the necessity of operating a creeper on a difficult surface.

Therefore, there persists a substantial need for an improved creeper, to cope more satisfactorily with difficult surfaces, beyond the capacity of the creepers presently known in the art. For example, there has been a particular need for creepers better suited to assist mechanics performing maintenance or repair or other mechanical work on large vehicles such as trucks and construction equipment. There has also been a particular need for creepers better suited to provide access in, under, and around fixtures such as houses, decks, warehouses, tanks, pipelines, etc. As another example, there has been a particular need for creepers better suited to assist mechanics performing maintenace or repair or other mechanical work in difficult environments, including outdoor environments on terrain that is rough, rocky, gravelly, sandy, soft, or otherwise not substantially smooth and hard.

SUMMARY OF THE INVENTION

Some embodiments of the present invention are directed to a creeper, including a body, and a rail interface coupled to the body, wherein the rail interface of the creeper is operatively engageable with a rail having a translational axis, wherein the rail interface of the creeper comprises a means for ensuring proper alignment of the rail interface relative to the rail, and wherein the creeper is enabled to translate from a first position to a second position along the translational axis of the rail.

Other embodiments of the present invention are directed to a creeper, including a body, and a rail interface coupled to the body; and a track, including a rail, with an elongated dimension defining a translational axis; wherein the rail interface of the creeper is operatively engageable with the rail, wherein the creeper is enabled to translate from a first position to a second position along the translational axis of the track.

DETAILED DESCRIPTION OF DEPICTED EMBODIMENTS

Figure 1:
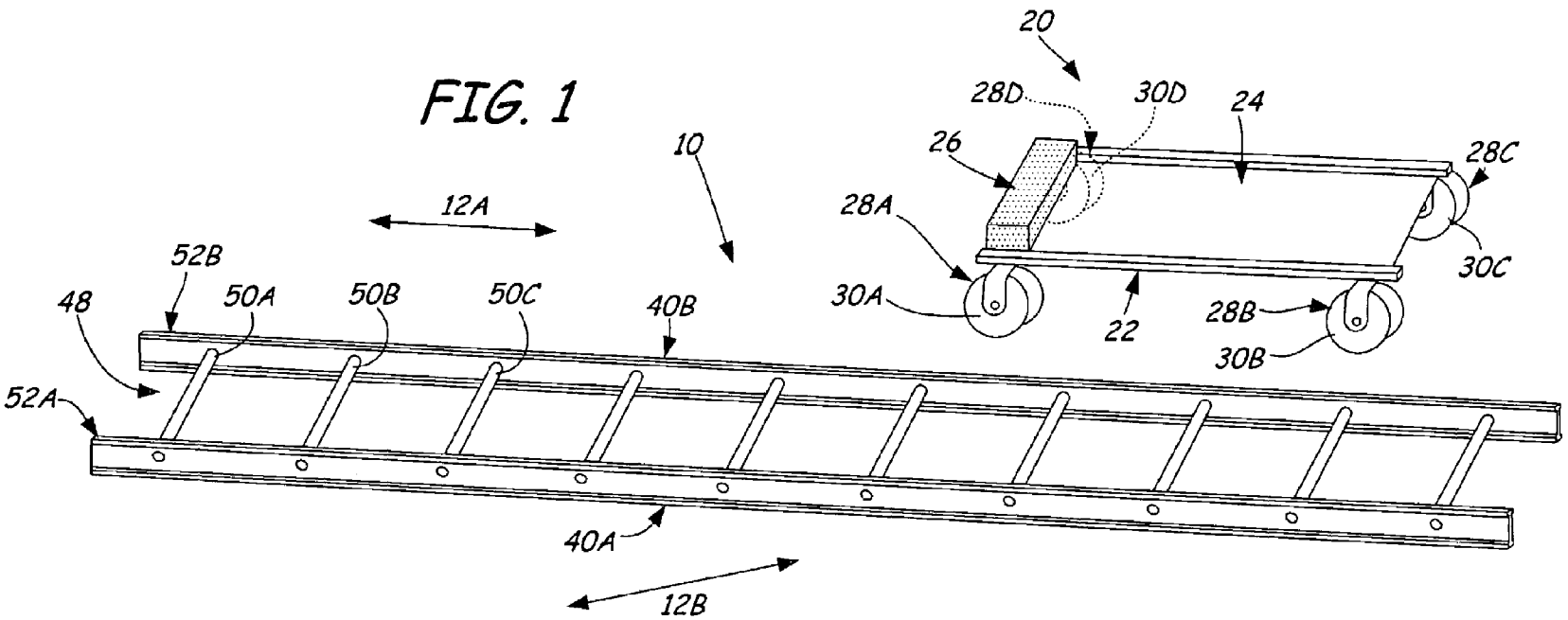
FIG. 1 depicts an embodiment of a creeper and a track.

FIG. 1 is a schematic diagram illustrating an embodiment of a track 10 and a creeper 20. In this embodiment, the creeper 20 includes a plurality of rail interfaces 28A, 28B, 28C, 28D disposed upon its underside 22. Each rail interface comprises one wheel 30A, 30B, 30C, 30D, such that the wheels 30A, 30B, 30C, 30D can be operatively engaged with a plurality of rails 40A, 40B along the track 10, with two rail interfaces and thereby two wheels operatively engageable with each rail 40A, 40B of the track 10, e.g. rail interfaces 28A and 28B and wheels 30A and 30B operatively engageable with rail 40A of track 10.

The track has a translational axis 12A, defined by the direction along which its rail or rails 40A, 40B are oriented and along which the creeper 20 may operably be translated. This track 10 may then be deployed along a useful orientation relative to a mechanical subject (not shown) upon which the mechanic (not shown) intends to work, with the creeper 20 engaged with the track 10 such that the wheels 30A, 30B, 30C, 30D are operatively engaged with the rails 40A, 40B, and the creeper 20 disposed to translate freely along translational axis 12A.

The creeper 20 in FIG. 1 includes four rail interfaces 28A, 28B, 28C, 28D, including, respectively, wheels 30A, 30B, 30C, 30D, capable of being operatively engaged with track 10 with two parallel rails 40A, 40B, with two wheels engaging each of the two rails 40A, 40B. The rails 40A, 40B are held in a fixed position relative to each other by a plurality of intervening crossties 50A, 50B, 50C, etc. The upper surface 24 of the creeper 20 includes a headrest 26. Any other number of rails and wheels can be used in alternative embodiments of the rail interfaces 28A, 28B, 28C, 28D.

The mechanic may recline or lie supine upon the upper surface 24 of creeper 20 and roll the creeper 20 easily in either direction along translational axis 12A, to a desired position along the track 10, where the user may commence performing work upon a mechanical object. Later, the mechanic may roll the creeper 20 along translational axis 12A along the track 10 to a new position and continue performing work upon the mechanical object from that new position. Or, the mechanic may slide the track 10 laterally, in a direction substantially perpendicular to the translational axis 12A of the track 10, in order to place a new axial swath of positions within the new translational axis 12B of the track 10.

Figure 2:
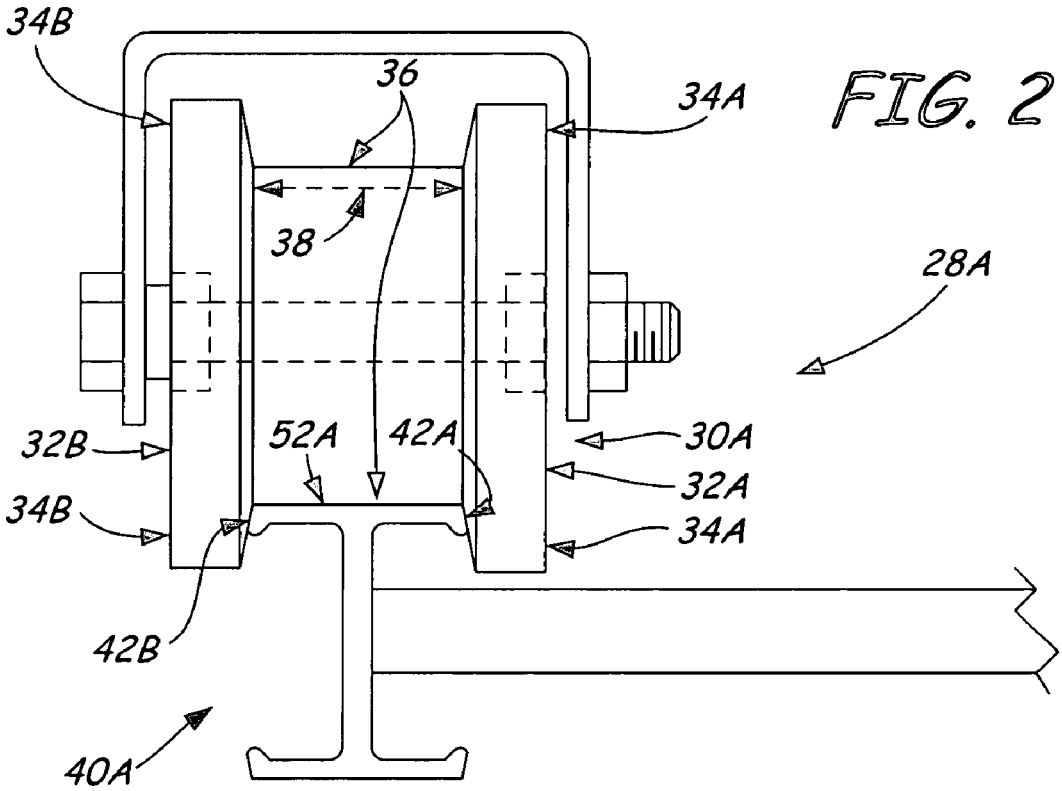
FIG. 2 depicts an embodiment of a rail interface and a rail.

FIG. 2 depicts one embodiment of a rail interface 28A, in which at least one of the wheels 30A is flanged, such that at least one of the axial ends 32A, 32B of the substantially cylindrical wheel 30A comprises a flange 34A, 34B, i.e. an annulus of greater radius than the central portion of the wheel, to act as a side guide for the wheel. FIG. 2 depicts a flange 34A, 34B on each of the two axial ends 32A, 32B of a wheel 30A. Each flange 34A, 34B rolls along a side-wall 42A, 42B of the rail 40A as the wheel 30A to which it is attached rolls upon the rail 40A, such that the flange 34A, 34B prevents the wheel 30A from becoming operatively disengaged from the rail 40A and no longer able to roll substantially freely thereon.

In one exemplary embodiment, as also depicted in FIG. 1 and FIG. 2, each wheel 30A, 30B, 30C, 30D bears a flange on each axial end 32A, 32B of its cylindrical form, such that the central, weight-bearing portion 36 of a wheel 30A, 30B, 30C, 30D engages operatively with a rail 40A, 40B and is able to roll freely thereon, while the flanges 34A, 34B on either axial end 32A, 32B of the wheel 30A, 30B, 30C, 30D pass along either side of the rail 40A, 40B, with the longitudinal spacing 38 of the inter-flange, weight-bearing portion 36 of the wheel 30A, 30B, 30C, 30D preferably set substantially equal to the gauge of the rail 40A, 40B, as shown in FIG. 2, to allow for a precision fit between the wheel 30A, 30B, 30C, 30D and the rail 40A, 40B.

Figure 3:
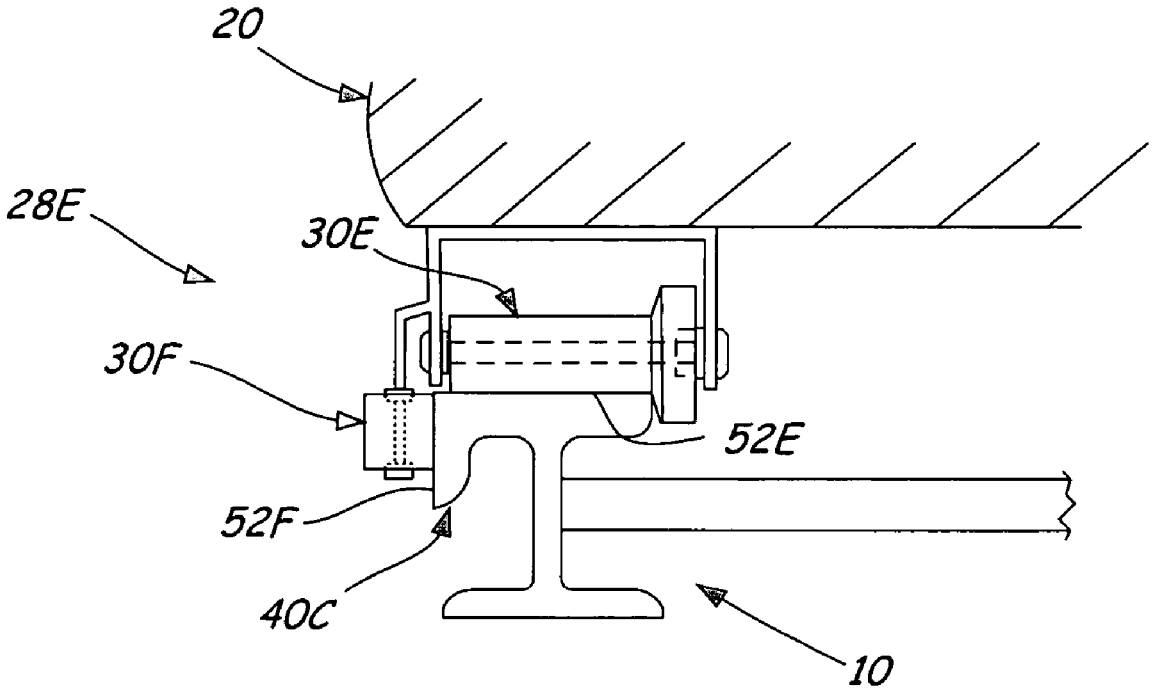
FIG. 3 depicts another embodiment of a rail interface and a rail.

FIG. 3 depicts another embodiment of a rail interface 28E, wherein the creeper 20 comprises at least one rail interface 28E comprising a plurality of wheels 30E, 30F. In this particular embodiment, each wheel 30E, 30F is disposed along different orientations relative to the rail 40C, while in operative coupling with the rail 40C. In this embodiment, each wheel 30E, 30F of a rail interface 28E rolls along a different, corresponding path surface 52E, 52F of the corresponding rail 40C, giving the rail interface 28E added stability. At least one such surface of the rail 40C may be a substantially horizontal path surface 52E or bear relatively most of the weight, while at least one other such surface may be a side-wall surface 52F, which may have any angle relative to the substantially horizontal path surface 52E.

Figure 4:
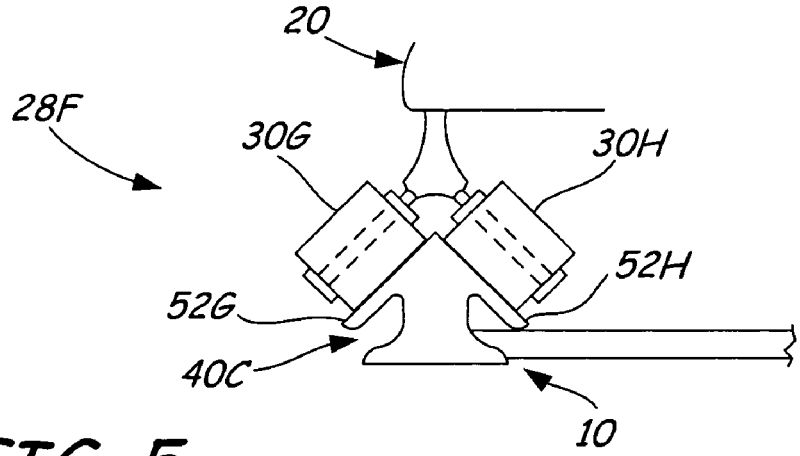
FIG. 4 depicts another embodiment of a rail interface and a rail.
Figure 5:
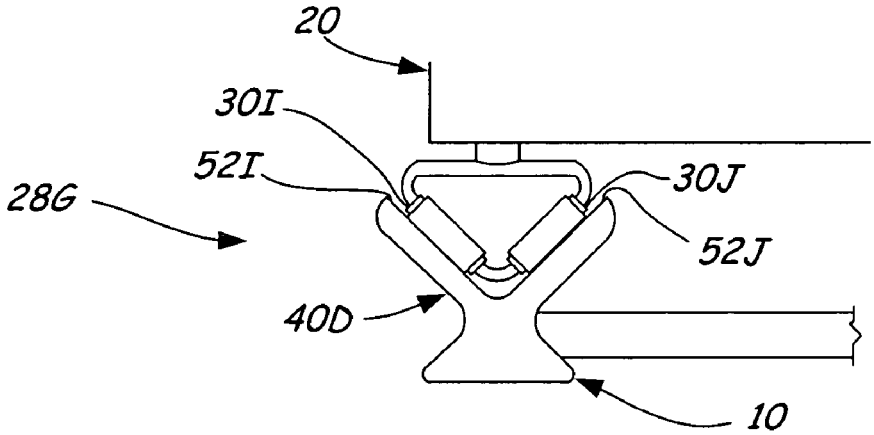
FIG. 5 depicts another embodiment of a rail interface and a rail.
Figure 6:
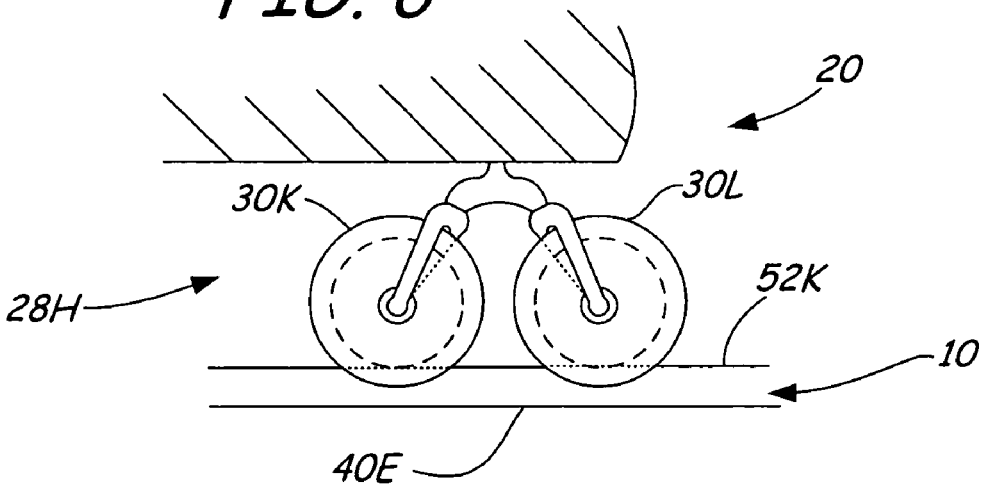
FIG. 6 depicts another embodiment of a rail interface and a rail.

In another embodiment of a rail interface 28F, 28G, as in FIGS. 4 and 5, at least two wheels 30G, 30H, 30I, 30J may both be set at angles, operatively engageable with angled path surfaces 52G, 52H, 52I, 52J. In some forms of this embodiment of the rail interface 28F, 28G more than one wheel 30G, 30H, 30I, 30J may significantly share in bearing the weight of creeper 20 upon track 10. In still another embodiment of a rail interface 28H, as in FIG. 6, a single rail interface 28H comprises plural wheels 30K, 30L in a substantially similar orientation to the rail 40E.

Figure 7:
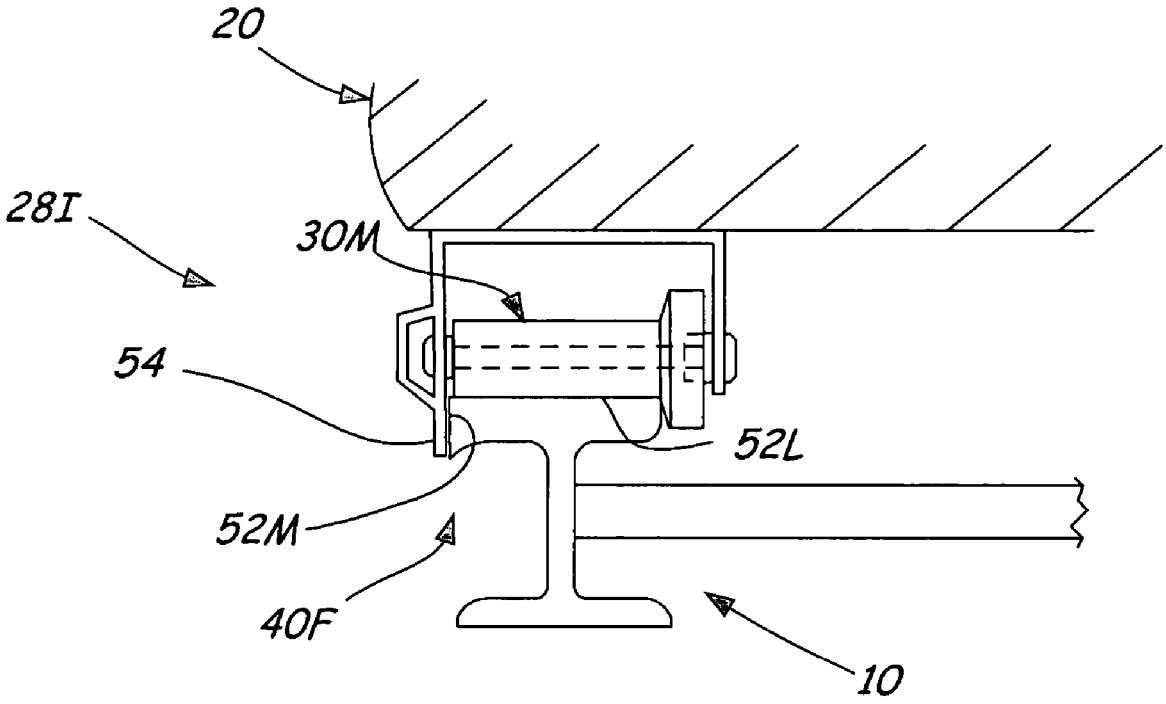
FIG. 7 depicts another embodiment of a rail interface and a rail.

In another embodiment of the rail interface 28I, as in FIG. 7, the rail interface 281 comprises at least one wheel 30M and one guide bar 54, such that the guide bar 54 is disposed in a substantially fixed position relative to the wheel 30M, such that the wheel 30M is operatively engageable with the rail 40F in such a way that the wheel 30M may be engaged with a wheel-bearing path surface 52L of the rail 40F at the same time that the guide bar 54 is suspended relatively closely to a guide bar engaging surface 52M of the rail 40F, such that significantly misaligned motion of the rail interface 28I relative to the rail 40F will cause the guide bar 54 to press against the guide bar engaging surface 52M of the rail 40F to maintain the operative engaging of the wheel 30M with the rail 40F.

Figure 8:
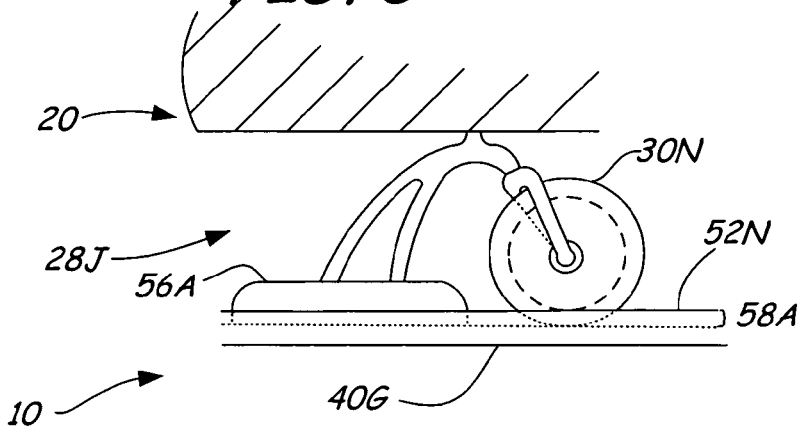
FIG. 8 depicts another embodiment of a rail interface and a rail.
Figure 9:
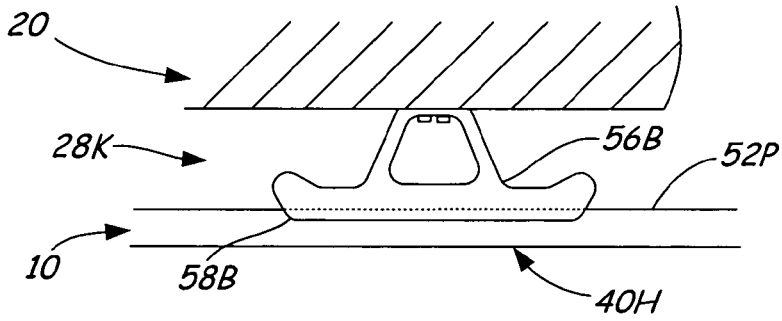
FIG. 9 depicts another embodiment of a rail interface and a rail.

In other embodiments of the rail interface 28J, as in FIGS. 8 and 9, the rail interface 28J, 28K comprises at least one sliding runner 56A in combination with at least one wheel 30N, as in FIG. 8, or at least one sliding runner 56B in place of any wheels, as in FIG. 9. In these cases, the sliding runner 56A, 56B slides along a path surface 52N, 52P of the rail 40G, 40H. In some forms, these embodiments include either the rail 40G or the sliding runner 56B having at least one flange 58A, 58B that extends either along a side of the runner 56A, and if present, the wheel 30N, as in FIG. 8, or along a side-wall of the rail 40H, as in FIG. 9, to maintain a proper alignment of the rail interface 28J, 28K with the rail 40G, 40H.

Figure 10:
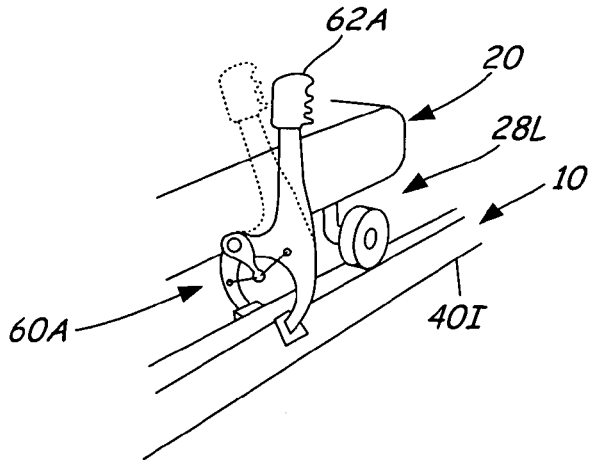
FIG. 10 depicts an embodiment of a translational locking device, a rail interface and a rail.

In embodiments of the mechanic's track creeper such as that depicted in FIG. 10, the creeper 20 includes a translational locking device 60A, which can be engaged with the track 10 or otherwise to brake the creeper 20 and fix the creeper 20 in a translational position along the track 10, and which can later be released to allow the creeper 20 freedom of motion along the translational axis 12A of the track 10 once again. The translational locking device 60A has translational locking device user interface 62A, preferably disposed for convenient use by the user (not shown) of the creeper 20.

Figure 11:
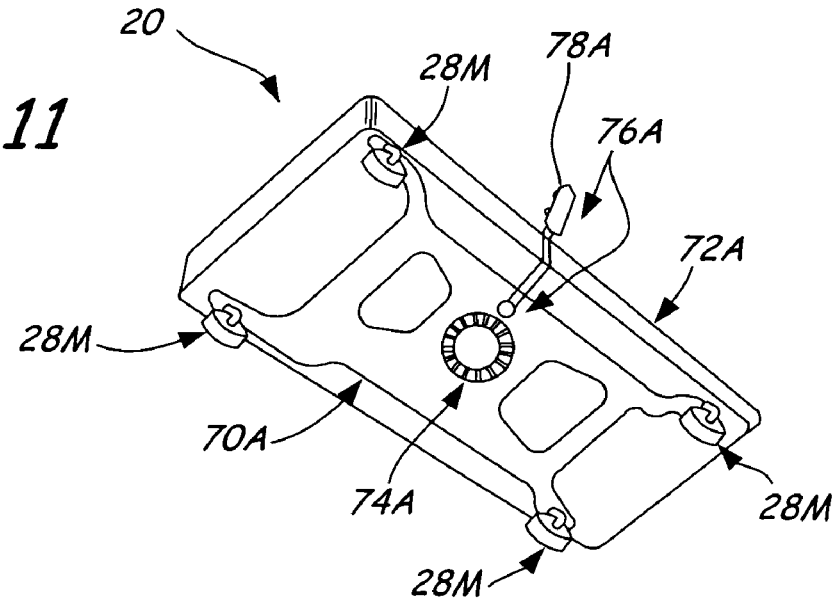
FIG. 11 depicts an embodiment of a creeper including upper frame, lower frame, rotational locking device, and rail interfaces.
Figure 12:
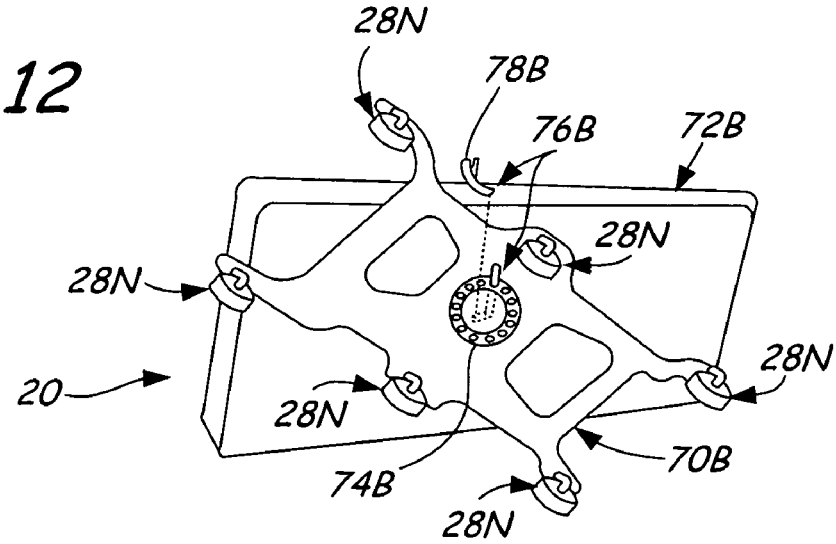
FIG. 12 depicts an embodiment of a creeper including upper frame, lower frame, rotational locking device, and rail interfaces.

In embodiments of the mechanic's track creeper such as those shown in FIGS. 11 and 12, the creeper 20 comprises a lower frame 70A, 70B comprising at least one rail interface 28M, 28N. This lower frame 70A, 70B is operatively coupled with an upper frame 72A, 72B by means of a swivel coupling 74A, 74B. This swivel coupling 74A, 74B allows the upper frame 72A, 72B, upon which the user (not shown) may be situated, to rotate freely relative to the orientation of the lower frame 70A, 70B. In some embodiments, this swivel coupling 74A, 74B includes a rotational locking device 76A, 76B that, when engaged, substantially fixes the rotational orientation of the upper frame 72A, 72B relative to the lower frame 70A, 70B, in any of a number of orientations, and when released, allows the upper frame 72A, 72B once again to rotate freely relative to the lower frame 70A, 70B. The rotational locking device 76A, 76B includes a rotational locking device user interface 78A, 78B, preferably disposed for convenient use by the user (not shown) of the creeper 20.

Figure 13:
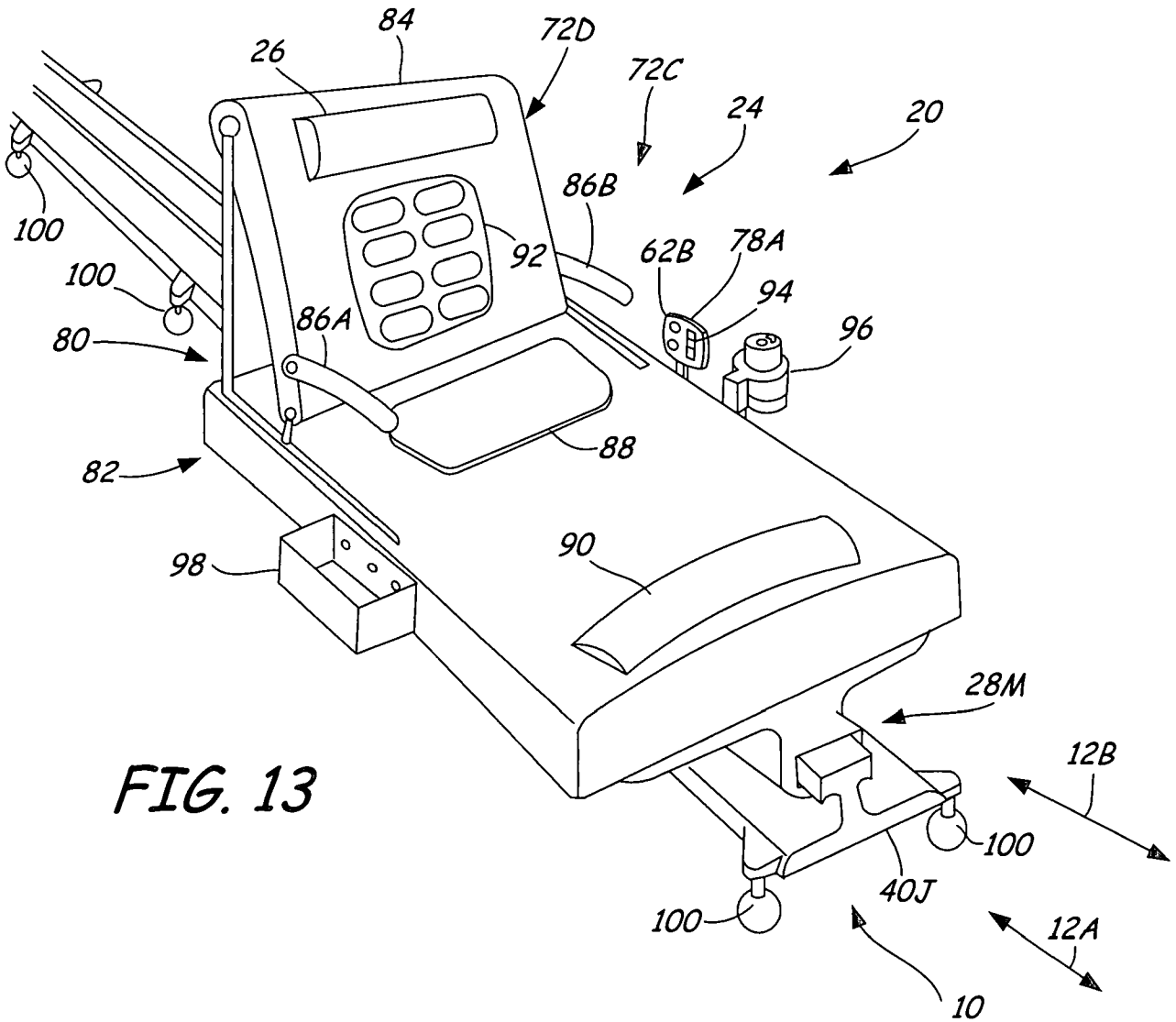
FIG. 13 depicts an embodiment of a creeper including raising and lowering portion, features providing comfort and convenience, and rail interface; and an embodiment of a track having a single rail and casters.

In embodiments of the mechanic's track creeper such as those shown in FIG. 13, the upper frame 72C or a portion thereof 72D, of the creeper 20, upon which the user (not shown) may be situated, is disposed to raise or lower in a substantially vertical dimension. This raising or lowering motion can be either manual, or through a hydraulic, pneumatic, electrical, or other system. This motion may also comprise a translation of the upper frame 72C or portion thereof 72D, or a rotation of the upper frame 72C or portion thereof 72D along a connecting interface 80 with a connecting portion 82 of the creeper, such as for example to rotate a backrest 84 upwards to allow the user to rise from a substantially supine to a substantially reclining or seated orientation. The translational locking device user interface 62B and the rotational locking device user interface 78A preferably remain conveniently disposed for operation.

In some embodiments, such as the one depicted in FIG. 13, the upper surface 24 of the creeper 20 has a variety of features designed to contribute to the comfort or convenience of the user. Such features include a headrest 26, a backrest 84, armrests 86A, 86B, a seat 88, a footrest 90, a back massager 92 with user control device 94, a cup-holder 96, or a toolbox 98, for example. Such features can transform among several configurations, in some embodiments, to adapt to particular uses, such as the raising or lowering portion 72D comprising the backrest 84 or the seat 88, for example.

Returning to FIG. 1, some embodiments of the track 10 comprise two rails 40A, 40B, fixed parallel to each other by an intermediate structure 48, such as at least one crosstie or support beam 50A, 50B, 50C. Each rail 40A, 40B features a smooth, elongated path surface 52A, 52B suitable for a rail interface, e.g. 28A, to roll along. A path surface 52A may have side-walls 42A, 42B on either side suitable for wheel flanges 34A, 34B or another form of side guides, e.g. 54 (shown in FIG. 7), to pass next to, or flanges or side-bars, e.g. 58A (shown in FIG. 8), extending from the rail, e.g. 40G (shown in FIG. 8), in a manner such that if the rail interface, e.g. 28A, were to begin to roll out of alignment with the path surface, e.g. 52A of the rail, e.g. 40A, the flange 34A or side guide would press against the side-wall 42A, or the flange or side-bar 58A of the rail 40G would press against the rail interface, e.g. 28J, to keep the rail interface, e.g. 28A operatively coupled with the rail, e.g. 40A. Other embodiments of the track 10 comprise only a single rail 40J, as shown in FIG. 13.

In some embodiments of the track 10, e.g. in FIG. 1, the lower portion of the track 10 rests directly on the ground or floor (not shown). In other embodiments of the track 10, e.g. in FIG. 13, the track 10 itself is mounted upon wheels, sliders, or casters 100, to facilitate translating or rotating the orientation of the track 10 itself laterally to the orientation of the track's translational axis 12A along which the creeper 20 is disposed to translate, establishing a new translational axis 12B.

Different embodiments of the track creeper provide various enhancements over conventional mechanic's creepers. The creeper is particularly useful with a broad variety of standard applications involving vehicles, structures, and other objects requiring repair or maintenance; in either a garage, a driveway, a construction site, a field setting, or other work environment; and on surfaces of all types and roughness, including terrain that is rough, rocky, or otherwise difficult to negotiate.

Although the present invention has been described with reference to certain representative embodiments, workers skilled in the art will recognize that changes may be made in form and detail without departing from the spirit and scope of the invention.

What is claimed is:

1. A mechanic's track creeper, comprising:

a body;

a support feature disposed on an upper surface of the body, configured to support a user thereon; and a rail interface coupled to the body, the rail interface being operatively engageable with a first rail having a translational axis, the rail interface comprising an outwardly protruding flange disposed on a first axial end of the rail interface, the flange configured such that when the rail interface is operatively engaged with the first rail, the flange is operatively disposed along a first side-wall of the first rail, thereby ensuring substantially proper alignment of the rail interface relative to the first rail;

wherein the creeper is enabled to translate from a first position to a second position along the translational axis of the first rail;

wherein the rail interface comprises a first wheel, rotatably mounted on the body, and configured to operatively engage with the first rail, wherein the outwardly protruding flange is disposed on a first axial end of the wheel; and wherein the rail interface also comprises a guide bar configured to slidingly contact the side-wall of the first rail when the wheel is operatively engaged with the first rail, thereby further ensuring substantially proper alignment of the first wheel relative to the first rail.

2. The A mechanic's track creeper, comprising:

a body;

a support feature disposed on an upper surface of the body, configured to support a user thereon; and a rail interface coupled to the body, the rail interface being operatively engageable with a first rail having a translational axis, the rail interface comprising an outwardly protruding flange disposed on a first axial end of the rail interface, the flange configured such that when the rail interface is operatively engaged with the first rail, the flange is operatively disposed along a first side-wall of the first rail, thereby ensuring substantially proper alignment of the rail interface relative to the first rail;

wherein the creeper is enabled to translate from a first position to a second position along the translational axis of the first rail;

wherein the rail interface comprises a first wheel, rotatably mounted on the body; and configured to operatively engage with the first rail, wherein the outwardly protruding flange is disposed on a first axial end of the wheel;

further comprising at least a second wheel, rotatably mounted on the body at a lateral displacement from the first wheel, and configured to operatively engage with a second rail disposed at a lateral displacement from the first rail, the second wheel comprising an outwardly protruding flange on a first axial end of the second wheel, the flange of the second wheel configured such that when the second wheel is operatively engaged with the second rail, the flange of the second wheel is operatively disposed along a first sidewall of the second rail, thereby ensuring substantially proper alignment of the second wheel relative to the second rail; and wherein the creeper comprises a translational locking device that comprises a user interface and a brake, configured such that the user interface is accessibly manipulable by a user situated on the support feature to selectively engage or disengage the locking device, the locking device configured such that when engaged, the locking device applies the brake against the rail, thereby substantially fixing the creeper in a first translational position along the rail; and when disengaged, the locking device allows translational freedom of motion of the creeper along the rail.

3. The mechanic's track creeper of claim 2 further comprising at least a third wheel and a fourth wheel, the third wheel rotatably mounted on the body in line with the first wheel, and the fourth wheel rotatably mounted on the body in line with the second wheel and at a lateral displacement from the third wheel; wherein the third and fourth wheels are configured to operatively engage with the first and second rails, respectively, the third and fourth wheels each comprising an outwardly protruding flange on first axial ends of the third and fourth wheels, respectively, the flange of the third wheel configured such that when the third wheel is operatively engaged with the first rail, the flange of the third wheel is operatively disposed along the first side-wall of the first rail, and the flange of the fourth wheel configured such that when the fourth wheel is operatively engaged with the second rail, the flange of the fourth wheel is operatively disposed along the first side-wall of the second rail.

4. The mechanic's track creeper of claim 2 wherein the first wheel further comprises a second outwardly protruding flange disposed on a second axial end of the wheel, axially opposing the flange on the first axial end of the wheel, the second flange configured such that when the wheel is operatively engaged with the rail, the second flange is operatively disposed along a second side-wall of the rail diametrically opposing the first side-wall of the first rail, thereby further ensuring substantially proper alignment of the first wheel relative to the rail.

5. The mechanic's track creeper of claim 2 further comprising at least a third wheel, configured to operatively engage with the first rail, the third wheel comprising an outwardly protruding flange on a first axial end of the third wheel, the flange of the third wheel configured such that when the third wheel is operatively engaged with the first rail, the flange of the third wheel is operatively disposed along the side-wall of the first rail, thereby ensuring substantially proper alignment of the third wheel relative to the first rail.

6. A mechanic's track creeper, comprising:

a body;

a support feature disposed on an upper surface of the body, configured to support a user thereon; and a rail interface coupled to the body, the rail interface being operatively engageable with a first rail having a translational axis, the rail interface comprising an outwardly protruding flange disposed on .a first axial end of the rail interface, the flange configured such that when the rail interface is operatively engaged with the first rail, the flange is operatively disposed along a first side-wall of the first rail, thereby ensuring substantially proper alignment of the rail interface relative to the first rail; and wherein the creeper is enabled to translate from a first position to a second position along the translational axis of the first rail; and wherein the body of the creeper comprises:

a lower frame, to which the rail interface is coupled;

a yaw swivel coupling, coupled to the lower frame; and an upper frame, operatively coupled to the yaw swivel coupling, providing the capability for the upper frame to be yaw rotated about a vertical axis relative to the lower frame.

7. The mechanic's track creeper of claim 6, further comprising a rotational locking device operatively engageable between the lower frame and the upper frame, such that the upper frame remains substantially rotationally fixed relative to the lower frame when the rotational locking device is engaged, and has substantial freedom of rotation relative to the lower frame when the rotational locking device is disengaged.

8. A mechanic's track creeper, comprising:

a body;

a support feature disposed on an upper surface of the body, configured to support a user thereon; and a first wheel, a second wheel, a third wheel, and a fourth wheel, each rotatably mounted on the body, the first and third wheels mounted in line with each other on a first side of the body and the second and fourth wheels mounted in line with each other on a second side of the body at a lateral displacement from the first side, the first and third wheels being operatively engageable with a first rail having a translational axis, and the second and fourth wheels being operably engageable with a second rail having a translational axis;

wherein the creeper is enabled to translate from a first position to a second position along the translational axes of the first and second rails;

wherein the first, second, third and fourth wheels each further comprise outwardly protruding flanges on first and second axially opposing ends thereof; the flanges of each of the first, second, third, and fourth wheels being configured such that when the first and third wheels are operatively engaged with the first rail, the first and second flanges of each of the first and third wheels are operatively disposed along diametrically opposing first and second side-walls of the first rail on first and second sides of the first rail, respectively; and the first and second flanges of each of the second and fourth wheels are configured such that when the second and fourth wheels are operatively engaged with the second rail, the first and second flanges of the second and fourth wheels are operatively disposed along diametrically opposing first and second side-walls of the second rail on first and second sides of the second rail, respectively.

9. The mechanic's track creeper of claim 8, further comprising a means for an upper surface of the body to translate substantially vertically.

10. The mechanic's track creeper of claim 8, wherein the body comprises a configurable upper surface capable of supporting a user in a relatively supine position in a first configuration, and capable of supporting a user in a relatively seated position in a second configuration.

11. A mechanic's track creeper 15, comprising:

a body;

a support feature disposed on an upper surface of the body, configured to support a user thereon;

first and second wheels, rotatably mounted to the body, at a lateral displacement to each other; and a track, comprising first and second rails, fixed in a substantially parallel disposition at a lateral displacement relative to each other by at least one intermediate crosstie, the first and second rails having an elongated dimension defining a translational axis, wherein the first and second wheels are operatively engageable with the first and second rails, respectively, enabling the creeper to translate from a first position to a second position along the translational axis of the track;

wherein the first and second wheels each comprise a first outwardly protruding flange disposed on a first axial end of the first and second wheels, respectively, the flanges configured such that when the first wheel is operatively engaged with the first rail, the flange of the first wheel is operatively disposed along a side-wall of the first rail, thereby ensuring substantially proper alignment of the first wheel relative to the first rail; and such that when the second wheel is operatively engaged with the second rail, the flange of the second wheel is operativel disposed along a side-wall of the second rail, thereby ensuring substantially proper alignment of the second wheel relative to the second rail; and wherein the creeper comprises a translational locking device that comprises a user interface and a brake, configured such that the user interface is accessibly manipulable by a user situated on the support feature to selectively engage or disengage the locking device, the locking device configured such that when engaged, the locking device applies the brake against the rail, thereby substantially fixing the creeper in a first translational position along the rail; and when disengaged, the locking device allows substantial translational freedom of motion of the creeper along the rail.

12. The mechanic's track creeper of claim 11, wherein the track comprises a lower surface that comprises a means for facilitating horizontal motion substantially laterally to the translational axis.

13. A mechanic's track creeper, comprising:

a body;

a support feature disposed on an upper surface of the body, configured to support a user thereon;

first and second wheels, rotatably mounted to the body, at a lateral displacement to each other; and a track, comprising first and second rails, fixed in a substantially parallel disposition at a lateral displacement relative to each other by at least one intermediate crosstie, the first and second rails having an elongated dimension defining a translational axis, wherein the first and second wheels we operatively engageable with the first and second rails, respectively, enabling the creeper to translate from a first position to a second position along the translational axis of the track;

wherein the first and second wheels each comprise a first outwardly protruding flange disposed on a first axial end of the first and second wheels, respectively, the flanges configured such that when the first wheel is operatively engaged with the first rail, the flange of the first wheel is operatively disposed along a side-wall of the first rail, thereby ensuring substantially proper alignment of the first wheel relative to the first rail; and such that when the second wheel is operatively engaged with the second rail, the flange of the second wheel is operatively disposed along a side-wall of the second rail, thereby ensuring substantially proper alignment of the second wheel relative to the second rail; and wherein the creeper comprises:

a lower frame, to which the rail interface is coupled;

a yaw swivel coupling, coupled to the lower frame; and an upper frame, operatively coupled to the yaw swivel coupling, providing the capability for the upper frame to be yaw rotated about a vertical axis relative to the lower frame.

14. The mechanic's track creeper of claim 13, further comprising at least a third wheel and a fourth wheel, the third wheel rotatably mounted on the body in line with the first wheel, and the fourth wheel rotatably mounted on the body in line with the second wheel and at a lateral displacement from the third wheel; wherein the third and fourth wheels are configured to operatively engage with the first and second rails, respectively, the third and fourth wheels each comprising an outwardly protruding flange on first axial ends of the third and fourth wheels, respectively, the flange of the third wheel configured such that when the third wheel is operatively engaged with the first rail, the flange of the third wheel is operatively disposed along the side-wall of the first rail, and the flange of the fourth wheel configured such that when the fourth wheel is operatively engaged with the second rail, the flange of the fourth wheel is operatively disposed along the side-wall of the second rail.

15. The mechanic's track creeper of claim 14, wherein the first, second, third and fourth wheels each further comprise second outwardly protruding flanges on second axial ends thereof, axially opposing the first axial ends thereof, the first and second flanges of each of the first and third wheels being configured such That when the first and third wheels are operatively engaged with the first rail, the first and second flanges of the first and third wheels are operatively disposed along diametrically opposing first and second side-walls of the first rail, respectively; and the first and second flanges of each of the second and fourth wheels are configured such that when the second and fourth wheels are operatively engaged with the second rail, the first and second flanges of the second and fourth wheels are operatively disposed along diametrically opposing first and second side-walls of the second rail, respectively.

* * * * *